US005445528A

United States Patent [19]

Frantz

[11] Patent Number: 5,445,528

[45] Date of Patent: Aug. 29, 1995

[54] ELECTRICAL CONNECTOR WITH IMPROVED MOUNTING

[75] Inventor: Robert H. Frantz, Newville, Pa.

[73] Assignee: The Whitaker Corporation, Wilmington, Del.

[21] Appl. No.: 251,060

[22] Filed: May 31, 1994

[51] Int. Cl.[6] ..... H01R 9/09

[52] U.S. Cl. ..... 439/79; 439/544; 439/729

[58] Field of Search ..... 439/76, 79, 441, 544–547, 439/554, 557, 725, 729

[56] References Cited

U.S. PATENT DOCUMENTS

| | | | |
|---|---|---|---|
| 1,255,248 | 2/1918 | Toll . | |
| 3,671,925 | 6/1972 | Drapkin . | |
| 3,691,430 | 9/1972 | Freltag | 317/101 DH |
| 3,785,049 | 1/1974 | Kanamaru et al. | 29/629 |
| 3,902,775 | 9/1975 | Speller . | |
| 3,915,544 | 10/1975 | Yurtin . | |
| 3,989,345 | 11/1976 | DeVito . | |
| 4,003,616 | 1/1977 | Springer . | |
| 4,006,960 | 2/1977 | Lacan . | |
| 4,128,289 | 12/1978 | Occhipinti . | |
| 4,162,819 | 7/1979 | Eisert . | |
| 4,256,358 | 3/1981 | Genz . | |
| 4,354,722 | 10/1982 | Morel . | |
| 4,533,796 | 8/1985 | Engelmore | 179/186 |
| 4,547,027 | 10/1985 | Scheibenreif . | |
| 4,558,911 | 12/1985 | Ruoff . | |
| 4,583,797 | 4/1986 | Engelmore et al. . | |
| 4,673,228 | 6/1987 | Ditzig | 439/21 |
| 4,700,997 | 10/1987 | Strand | 439/372 |
| 4,701,133 | 10/1987 | Worth | 439/13 |
| 4,731,030 | 3/1988 | Johnston | 439/6 |
| 4,764,121 | 8/1988 | Ditzig | 439/21 |
| 4,767,340 | 8/1988 | Hohorst | 439/729 |
| 4,795,377 | 1/1989 | Schmode et al. | 439/727 |
| 4,843,223 | 6/1989 | Shino | 235/487 |
| 4,850,882 | 7/1989 | Yu | 439/31 |
| 4,863,388 | 9/1989 | Reimer et al. | 439/31 |
| 4,865,553 | 9/1989 | Tanigawa et al. | 439/31 |
| 4,897,045 | 1/1990 | Dyck | 439/578 |
| 4,934,943 | 6/1990 | Klein et al. | 439/547 |
| 4,975,062 | 12/1990 | Evans et al. | 439/13 |
| 4,978,315 | 12/1990 | Edgley et al. | 439/441 |
| 5,013,224 | 5/1991 | Liao | 417/423.5 |
| 5,074,796 | 12/1991 | Carter | 439/24 |
| 5,098,317 | 3/1992 | Lau | 439/729 |
| 5,106,306 | 4/1992 | Ditzig | 439/26 |
| 5,139,281 | 8/1992 | Dzioba | 280/775 |
| 5,168,429 | 12/1992 | Hosoi | 361/395 |
| 5,178,546 | 1/1993 | Dickerson | 439/13 |
| 5,199,896 | 4/1993 | Mosquera | 439/557 X |
| 5,233,502 | 8/1993 | Beatty et al. | 361/729 |
| 5,234,347 | 8/1993 | Kang | 439/26 |
| 5,237,488 | 8/1993 | Moser et al. | 361/729 |
| 5,238,421 | 8/1993 | Kobayashi | 439/165 |
| 5,240,427 | 8/1993 | Kobayashi | 439/165 |
| 5,253,139 | 10/1993 | Satou | 361/681 |
| 5,277,613 | 1/1994 | Neward | 439/729 |
| 5,277,623 | 1/1994 | Colleran et al. | 439/557 |
| 5,292,260 | 3/1994 | Sinisi et al. | 439/441 |

FOREIGN PATENT DOCUMENTS

| | | |
|---|---|---|
| 2251738 | 7/1992 | United Kingdom . |
| 2256325 | 12/1992 | United Kingdom . |

*Primary Examiner*—Khiem Nguyen

[57] ABSTRACT

A connector (20) for electrically connecting the conductor (24) of a wire (22) to circuitry on a circuit board (14) within an electrical unit (10) is disclosed. The connector includes an insulating housing (32) with two side by side cavities (60) separated by a wall (62), each cavity containing an electrical contact (34). A pair of conductor openings (72) are formed in the front end (30) of the housing side by side so that each opening is in alignment with one of the cavities and in communication therewith. The conductors (24) are terminated to the contacts (34) by pushing them through the openings and into locking engagement with their respective contacts. A second opening (78) is provided to receive a tool (94) for releasing the contacts from locking engagement. A mounting device (82) is provided to secure the connector to the circuit board (14). Additionally, flanges (88) are provided on the housing to abuttingly engage the outer case (12) to prevent damage to the unit should the wires be inadvertently pulled away from the unit.

16 Claims, 5 Drawing Sheets

ELECTRICAL CONNECTOR WITH IMPROVED MOUNTING

The present invention relates to electrical connectors of the type that are mounted to a circuit board for receiving and interconnecting conductors to circuitry on the circuit board within electrical equipment.

BACKGROUND OF THE INVENTION

Electrical equipment that is assembled or installed in the field, especially where the equipment is not a single unit, frequently requires interconnection by means of electrical conductors. Terminals are usually provided on the equipment package for receiving these conductors. Such terminals include various screw and post type devices where the conductor is wrapped around a screw and the screw tightened, the conductor is inserted into a hole and a screw is tightened onto the conductor, or other similar devices. Electrical circuitry is usually provided in the form of circuit boards which are somewhat delicate and do not lend themselves to screw type terminals for interconnecting wiring. Additionally, when a wire is terminated to a circuit board in one piece of equipment and then routed to another piece of equipment and terminated there, especially in a home environment, the wire is prone to inadvertent pulling by something falling against the wire or by someone accidently tripping over it. The wire may be inadvertently pulled completely out of the equipment or, if locked in place, may damage the delicate circuit board or other parts of the equipment. In an effort to reduce the work involved in the field when installing systems, a poke home terminal system was developed where the conductor is simply inserted into a hole in the unit and a spring contact inside makes electrical contact with the conductor. However, these systems are not suitable for interconnecting wiring to the circuit boards of electrical equipment where the wiring is exposed to such hazards. An example of such a terminal is disclosed in U.S. Pat. No. 3,915,544 which issued Oct. 28, 1975 to Yurtin. There, a spring terminal is disclosed that interconnects a conductor with circuitry on a flexible circuit that is arranged on the surface of a panel. A cavity is provided in the panel to receive the spring terminal in alignment with an opening in the flexible circuit. Conductive strips of the flexible circuit overlay the opening so that when the terminal is pushed into the cavity, the strips are deflected into the cavity and into electrical engagement with the terminal. Spring tabs deflect around the panel opening and snap into place behind the panel to hold the spring terminal in the cavity. A conductor to be terminated to the equipment is then inserted into a hole in the terminal to electrically engage a contact. This type of spring terminal does not lock the conductor in place within the terminal. Another type of poke home terminal system that is commonly used in household wall receptacles is disclosed in U.S. Pat. No. 3,671,925 which issued Jun. 20, 1972 to Drapkin. The '925 patent discloses a receptacle connector having an opening for receiving a conductive wire and a spring contact bar arranged adjacent the opening so that when a wire is inserted into the opening the contact electrically engages the conductor of the wire and securely locks it within the receptacle. Another hole is arranged adjacent the first hole for receiving a tool to deflect the contact away from the conductor for release thereof. The opposite side of the receptacle connector has suitable openings for receiving a plug having pin contacts that electrically engage contact surfaces that are part of the spring contact bar within the receptacle connector. However, this receptacle connector is not suitable to interconnect wires to the circuitry of circuit boards.

What is needed is a poke home type terminal system that mounts to a circuit board in electrical equipment for interconnecting the conductor of a wire to circuitry on the circuit board and locking the conductor in place. A release mechanism should be provided that releases the terminated conductor without overstressing the contact. Provision should be made for preventing damage to the equipment due to inadvertent pulling of the conductor in service.

SUMMARY OF THE INVENTION

An electrical connector is disclosed for mounting to a circuit board within an electrical component and interconnecting a conductor to circuitry on the circuit board. The component includes a panel having an opening therethrough for receiving an end of the connector. The connector includes an insulating housing having a first end for extending into the opening of the panel, a cavity formed in the housing, and an electrical contact in the cavity having a tail for electrically engaging the circuitry on the circuit board. A first opening extends through the first end of the housing and into communication with the cavity. The first opening and the contact are arranged so that when a conductor is inserted into the first opening the contact deflects and electrically engages the conductor. The connector includes securing means for securing the housing to the circuit board, and protective means for engaging the panel adjacent the panel opening when the connector is mounted to the circuit board to prevent inadvertent movement of the first end of the housing further into or through the panel opening.

DESCRIPTION OF THE PREFERRED EMBODIMENT

Figure 1:
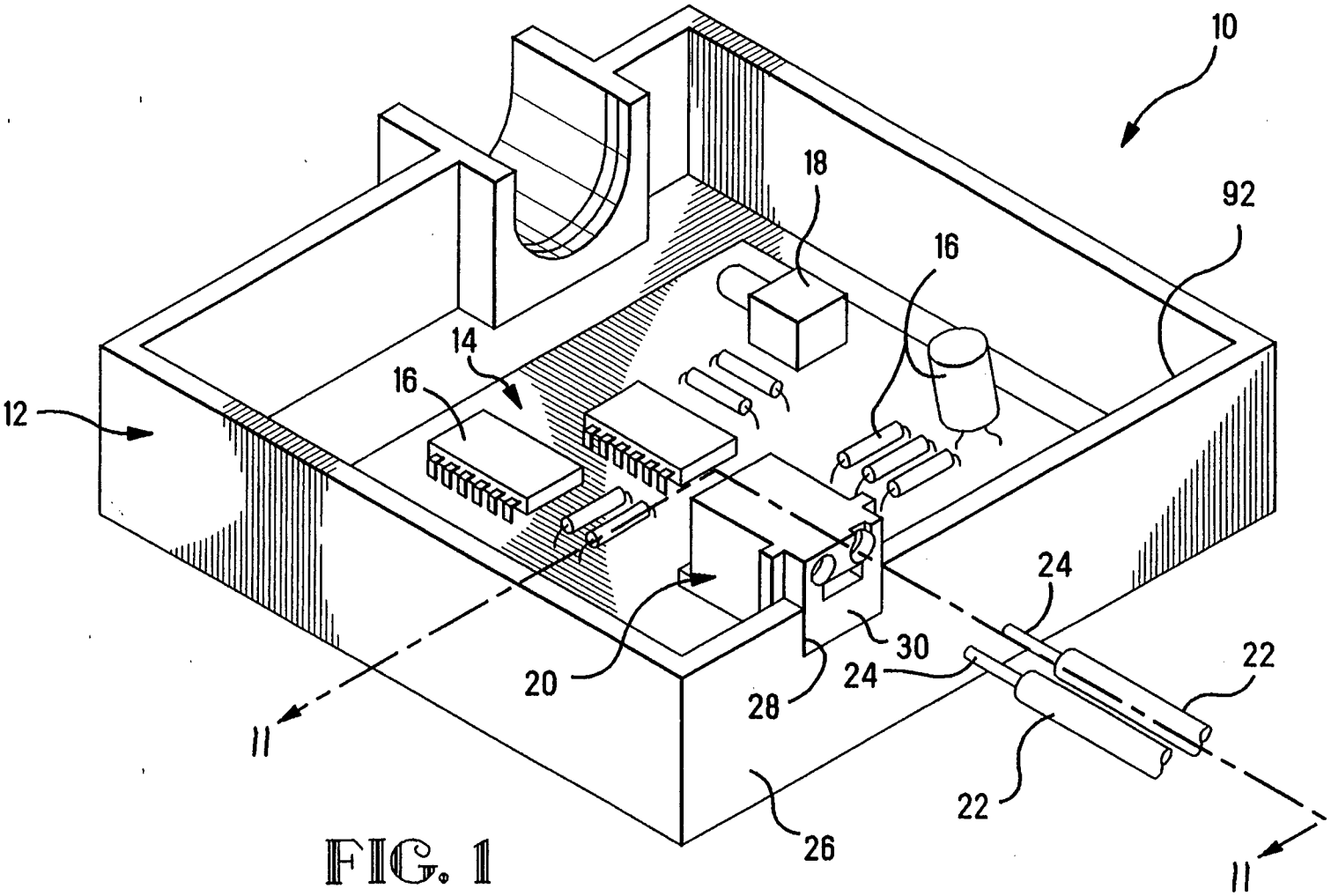
FIG. 1 is an isometric view of a unit of electrical equipment having an electrical connector incorporating the teachings of the present invention.

There is shown in FIG. 1 an electrical unit 10, which, in the present example, is a photo-sensor for use with an automatic garage door opening system. It will be understood that, while a photo-sensor is described herein, the teaching of the present invention may be advantageously utilized with other types of electrical equipment. The unit 10 includes an outer case 12, a circuit board 14 within the case having circuitry thereon, and electrical components 16 arranged on the circuit board in electrical engagement with the circuitry. A photo-sensor 18 is mounted on the circuit board 14 and positioned for receiving a light signal from a remote unit, not shown. An electrical connector 20 is mounted to the circuit board and has contacts in electrical engagement with the circuitry on the board 14. A pair of wires 22 having conductors 24 are terminated to the connector 20 and interconnect the photo-sensor unit 10 with a control unit, not shown, that is remote therefrom. The unit 10 is usually mounded on structure adjacent the door that is being controlled while the control unit is usually mounted with the power unit, not shown, that physically opens the door. This necessitates routing the wires 22 along the door jamb, up the wall to the ceiling, and across the ceiling to the power unit. The wires 22 are thereby exposed to accidental pulling by varying degrees, depending on the actual environmental conditions and the routing path chosen. It is, therefore, important that the connector 20 be adequately supported by the case 12 in the event that the wires are inadvertently pulled so that the circuit board and other internal components within the unit 10 are protected from possible damage. The case 12 includes a panel or side 26 having an opening 28 therethrough. A first end 30 of the connector 20 extends into the opening 28 so that it is approximately flush with the outside of the side 26, as shown in FIG. 1.

Figure 2:
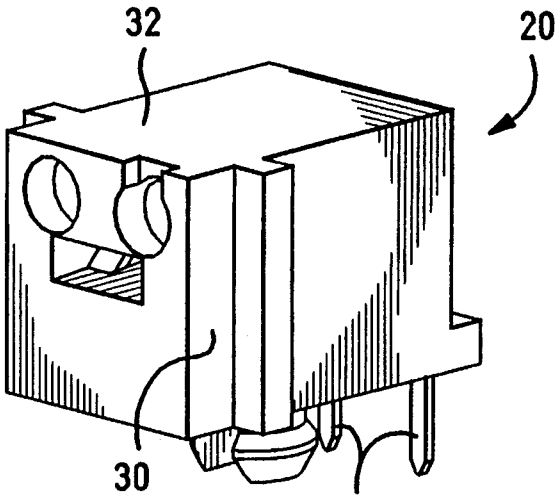
FIG. 2 is an isometric view of the connector shown in FIG. 1.
Figure 4:
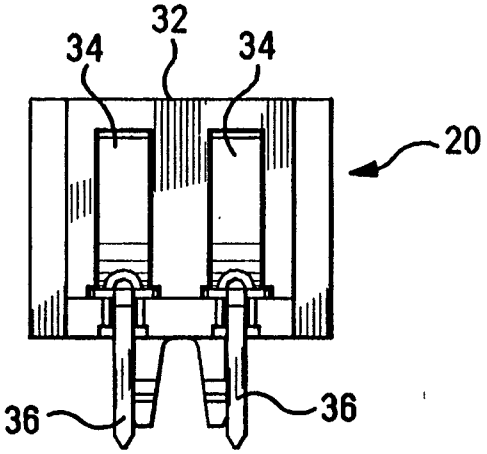
FIG. 4 is a back view of the connector shown in FIG. 2.
Figure 3:
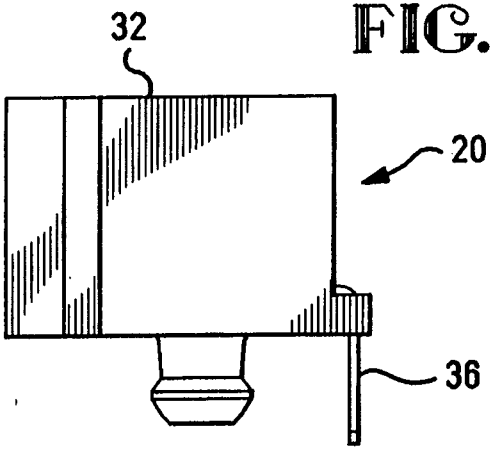
FIG. 3 is a side view of the connector shown in FIG. 2.
Figure 10:
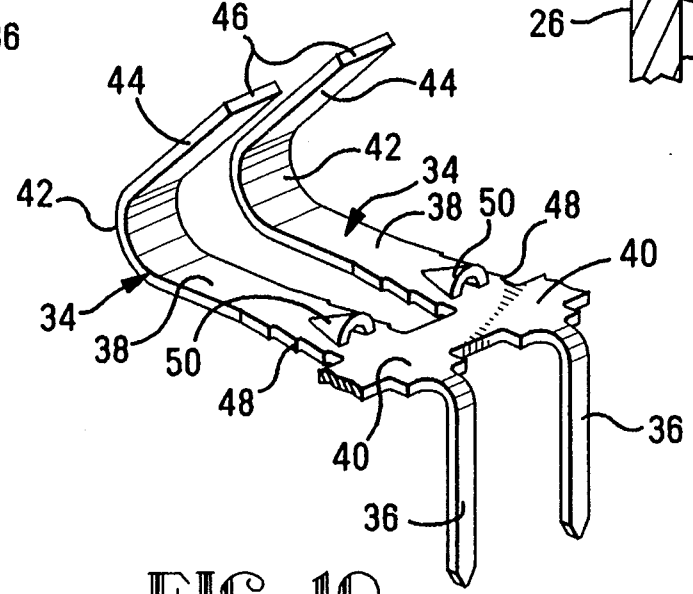
FIG. 10 is an isometric view of two electrical contacts that are used in the connector shown in FIG. 2.

The connector 20, as best seen in FIGS. 2, 3, and 4, includes an insulating housing 32, two electrical contacts 34 having solder tails 36. Each contact 34, as shown in FIG. 10, includes a lower beam 38 extending from a shank 40, the contact then bending upwardly about a radiused portion 42, past the vertical and back over itself to form an upper beam 44 having a conductor engagement edge 46. The shank 40 includes barbs 48 on each side thereof for anchoring the contact in the housing, as will be described. A dimple 50 is formed in the shank 40 of each contact 34 and is used as an abutting surface when inserting the contact into the housing 32.

Figure 7:
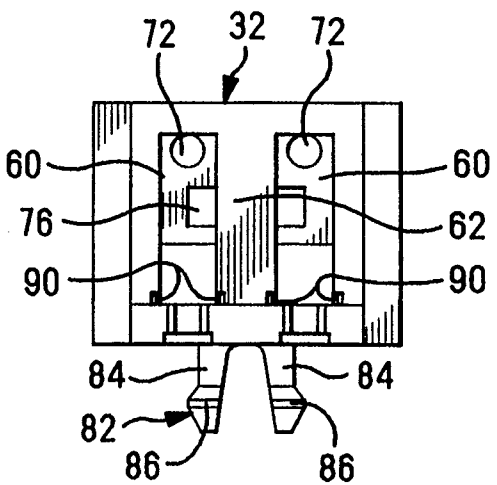
FIGS. 5, 6, and 7 are front, side, and back views of the insulating housing of the connector shown in FIG. 2.
Figure 8:
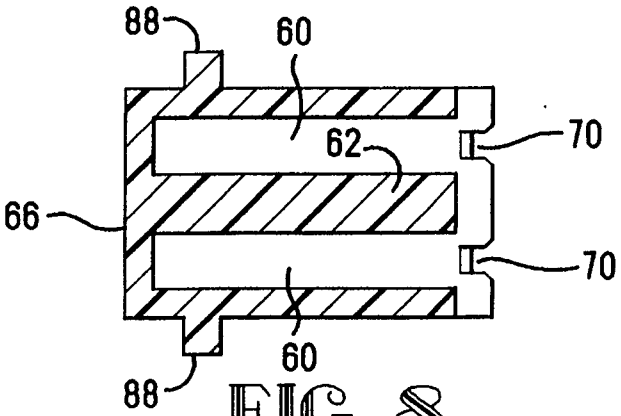
FIG. 8 is a cross-sectional view taken along the lines 8—8 in FIG. 6.
Figure 6:
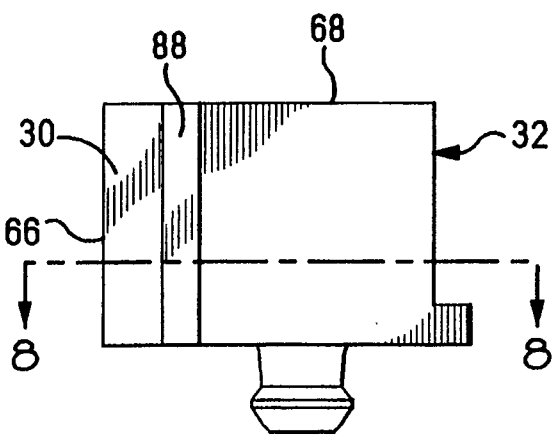
Figure 5:
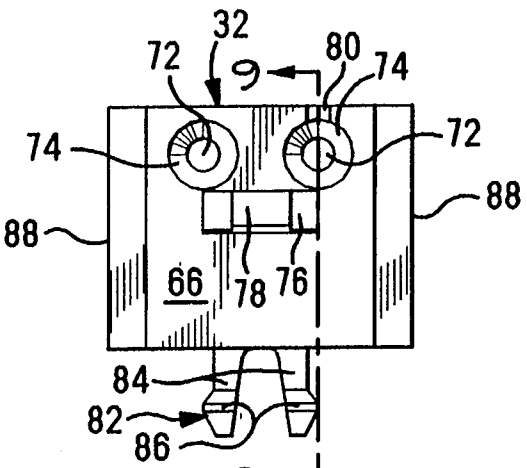
Figure 9:
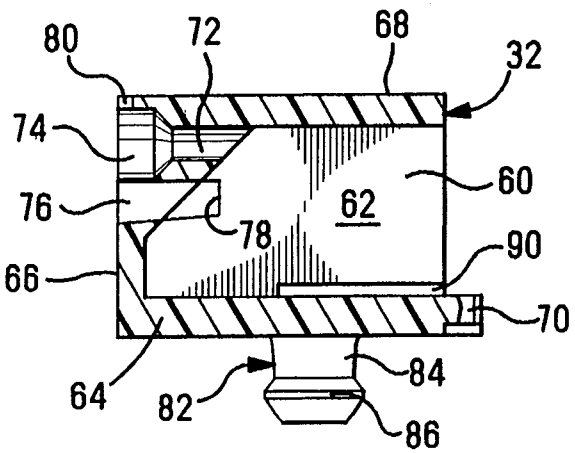
FIG. 9 is a cross-sectional view taken along the lines 9—9 in FIG. 5.

The connector housing 32, as shown in FIGS. 5 through 9, includes two cavities 60 arranged side by side and separated by a center wall 62, for receiving the two contacts 34. The housing has a base 64, the end 30 with a front wall 66, and a top 68. A pair of slots 70, as shown in FIG. 8, are formed in the base 64 for receiving the solder tails 36 of the contacts 34, as shown in FIG. 4. A pair of first openings 72 are formed through the end 30 and into the cavities 60, one opening communicating with one cavity and the other opening communicating with the other cavity. Each opening 72 is sized to receive one of the conductors 24 and includes a counterbore 74 sized to receive the insulated portion of the wire 22. A second opening 76 is formed through the first end 30 directly under the two first openings 72, as viewed in FIG. 5. The second opening is of rectangular shape, but may be of any suitable shape, and is roughly centered on the center wall 62 so that the opening intersects both of the cavities 60. The second opening terminates in an abutting surface 78 that is in the center wall 62, for a purpose that will be explained. A notch 80 is formed in the wall of the right most counterbore 72, as viewed in FIG. 5, and serves as a visual identification for purposes of maintaining correct polarity when inserting the two wires 22. A board lock device 82 is provided with two spaced arms 84 and enlarged ends 86 with tapered lead-in for inserting into a hole in the circuit board 14. A pair of flanges 88 project from the sides of the housing 32, one flange on each side as shown in FIGS. 5 through 8. The flanges are positioned a distance back from the front of the wall 66 that is approximately equal to the thickness of the side 26 of the case 12 so that when the end 30 is in position within the opening 28 the outer surface of the housing 32 is flush with the outer surface of the case 12. A pair of undercuts 90 are formed in the walls of each cavity 60 adjacent the base 64, as best seen in FIGS. 7 and 9. When the contacts are inserted into the cavities 60, their barbs 48 enter and interferingly engage the cutouts 90, thereby securing the contacts within their respective cavities. Just prior to inserting the contacts into the housing they are severed from their carrier strip in the usual manner.

Figure 13:
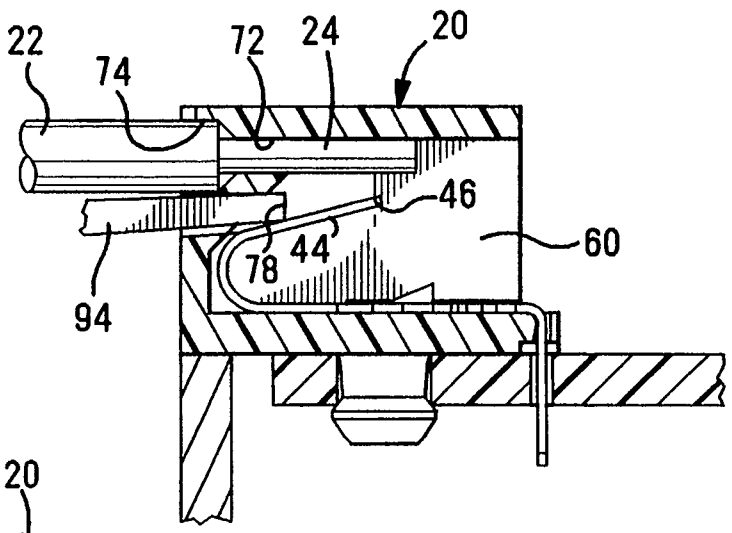
FIGS. 11, 12, and 13 are cross-sectional views taken along the lines 11—11 in FIG. 1 showing the connector in various states of operation.
Figure 12:
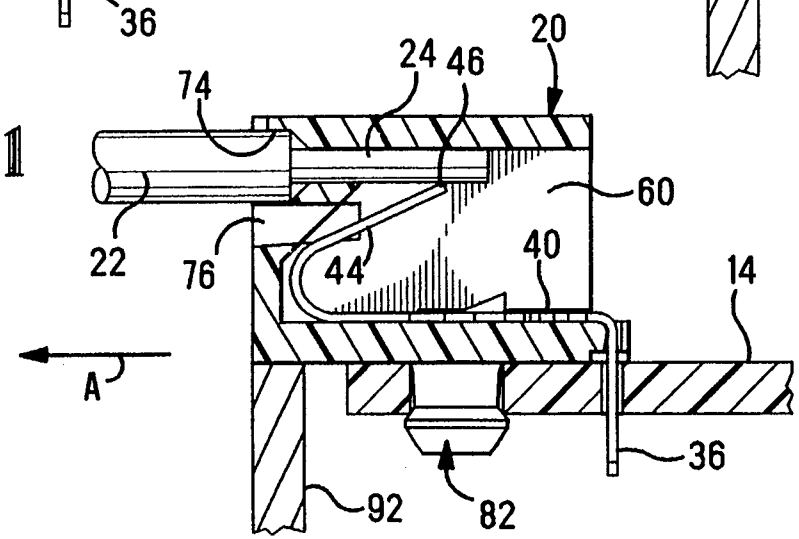
Figure 11:
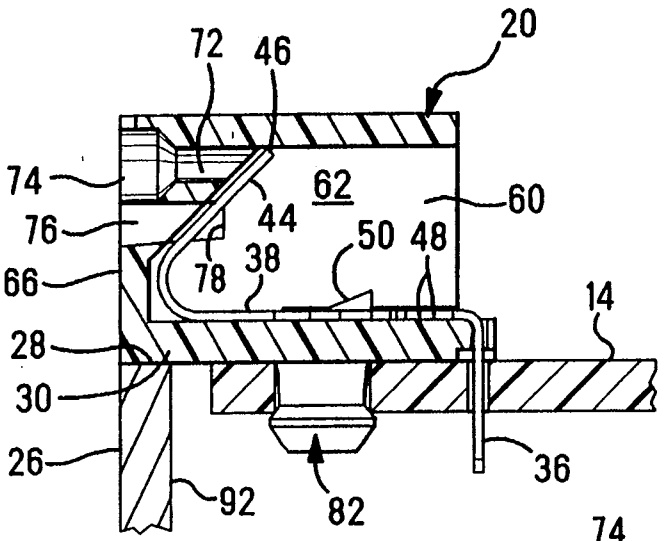

As shown in FIG. 11, the connector 20 is assembled to the circuit board 14 within the case 12 so that the end 30 is within the opening 28 and the outer surface of the wall 66 is about flush with the outer surface of the side or panel 26. In this position the two flanges 88 are against or nearly against the inner surface 92 of the panel 26, as shown in FIG. 1. In operation, each of the wires 22 are inserted into their respective first openings 72 so that the conductors 24 engage their respective contacts 34. As insertion occurs the end of the conductor 24 pushes against the upper beam 44, deflecting it downwardly toward the shank 40 until the conductor is able to pass between the edge 46 of the beam 44 and an inside surface 92 of the top 68 of the housing. The conductor 24 continues moving into the cavity 60 until the insulated covering on the wire 22 engages the bottom of the counterbore 74, as shown in FIG. 12. At this point the wire 22 is fully inserted into the connector and the edge 46 is urged outwardly by the resiliency in the two beams 38 and 44 and the radiused portion 42 with a force that is sufficient to lock the conductor 24 within the connector 20. Should the wires 22 be pulled away from the connector 20, in the direction of the arrow A in FIG. 12, the two flanges 88 would abut against the surface 92 on each side of the opening 28 and prevent movement of the connector housing 32 further into or through the opening 28. Additionally, the peripheral edges of the opening 28 closely conform to the shape of the end 30 so that the connector housing cannot rotate or move laterally within the opening any appreciable amount. This will prevent the connector housing from pulling the circuit board 14 and possibly damaging it or other components of the photo-sensor unit 10. When it is desired to remove the conductors 24 from locking engagement with the contacts 34, a tool 94 such as a small screw driver is inserted into the second opening 76 so that it engages and deflects the upper beam 44 away from the conductor 24, as best seen in FIG. 13. The edge 46 of the beam 44 is now spaced from the conductor 24 so that it can be removed. The tool 94 can be inserted into the second opening only until it engages the abutting surface 78 on the center wall 60, thereby limiting the amount of deflection to the contact 34. By positioning the abutting surface 78 a specific distance from the beam 44, the deflection will be limited to an amount within the elastic limit of the contact 34.

Figure 14:
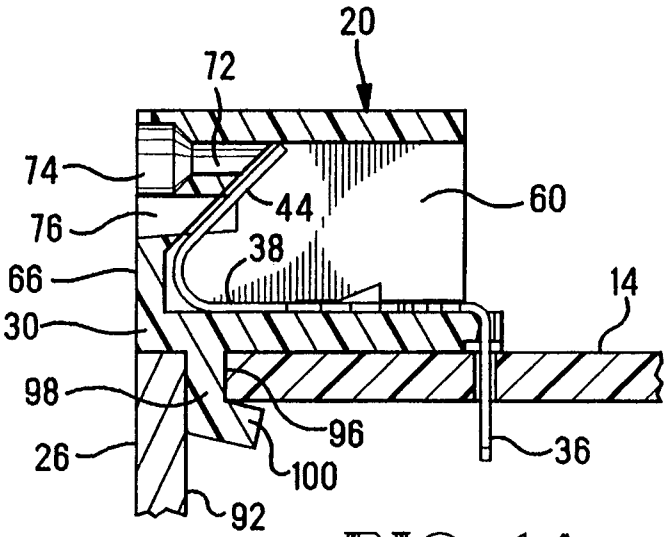
FIG. 14 is a view similar to that of FIG. 11 showing a second embodiment of the housing.

An alternative to the board lock 82 of the connector 20 is shown in FIG. 14. There, a board lock device 96 includes a rail 98 that extends from the bottom surface of the base 64, along the edge of the circuit board 14, and a lip 100 extends from the rail under the circuit board thereby forming a tapered opening so that the edge of the circuit board is wedged thereinto and securely held in place.

An important advantage of the connector of the present invention is that an interconnecting wire can be terminated to circuitry on a delicate circuit board contained within electrical equipment by simply pushing the end of the conductor into an opening in the connector. The connector is mounted to the delicate circuit board is supported by a panel of the equipment case thereby protecting the circuit board and other components from possible damage due to inadvertent pulling of the wire. A conductor release mechanism is provided that includes a stop surface for preventing the deflection of the contact beyond its elastic limit.

I claim:

1. An electrical connector for mounting to a circuit board within an electrical component and interconnecting a conductor with circuitry on said circuit board, wherein said component includes a panel having an opening therethrough for receiving an end of said connector, said connector comprising:

an insulating housing having a first end for extending into said panel opening of said panel, a cavity formed in said housing, an electrical contact in said cavity having a tail for electrically engaging said circuitry on said circuit board, a first opening through said first end of said housing in communication with said cavity, said first opening and said contact arranged so that when a conductor is inserted into said first opening said contact deflects and electrically engages said conductor, said connector including securing means for securing said housing to said circuit board, and protective means for engaging said panel adjacent said panel opening when said connector is mounted to said circuit board to prevent inadvertent movement of said first end relative to said circuit board of said housing further into or through said panel opening from one side of said panel for preventing damage to said electrical contact.

2. The connector according to claim 1 wherein said protective means includes at least one flange extending from said housing adjacent said first end arranged for abutting engagement with said panel when said connector is urged further into or through said panel opening.

3. The connector according to claim 2 wherein said at least one flange comprises two flanges for engaging said panel on opposite sides of said housing.

4. The connector according to claim 2 wherein said panel opening is defined by peripheral edges and said first end of said housing includes walls that are conformably shaped to said panel opening so that said first end is receivable into said panel opening until said flange abuts said panel and said walls are engagable with said peripheral edges to limit lateral or rotational movement of said housing with respect to said component said protective means including said conformably shaped walls.

5. The connector according to claim 4 wherein said securing means comprises a protrusion extending from a bottom surface of said housing and arranged to interferingly engage an opening in said circuit board.

6. The connector according to claim 4 wherein said securing means comprises a rail extending from a bottom surface of said housing and arranged to extend past an edge of said circuit board and thereunder.

7. An electrical connector for mounting to a circuit board within an electrical component and interconnecting a conductor to circuitry on said circuit board, said connector comprising:

an insulating housing having a first end, a cavity formed in said housing, an electrical contact in said cavity having a tail for electrically engaging said circuitry on said circuit board, first and second openings through said first end of said housing in communication with said cavity, means for securing said connector to said circuit board and within said component, said first opening and said contact arranged so that when a conductor is inserted into said first opening said contact deflects, electrically engages said conductor, and urges said conductor into interfering engagement with said housing thereby locking said conductor within said first opening, said second opening arranged so that when a tool is inserted into said second opening said contact is engaged by said tool and deflected away from said conductor thereby releasing said conductor from said interfering engagement with said housing, and wherein said housing includes a stop surface within said cavity in alignment with said second opening and arranged so that when said tool is inserted into said second opening to deflect said contact away from said conductor, said tool engages said stop surface thereby limiting said deflection of said contact.

8. The connector according to claim 7 wherein said second opening is between said first opening and said circuit board when said connector is mounted to said circuit board.

9. The connector according to claim 8 wherein said housing includes two cavities and two first openings arranged side by side, each being in communication with a respective cavity, a separate contact in each cavity, a wall separating said two cavities, said stop surface being on said wall in alignment with said second opening, said second opening intersecting both of said cavities so that when said tool is inserted thereinto, both said contacts are engaged by said tool and deflected away from their respective conductors.

10. The connector according to claim 9 wherein said means for securing said connector to said circuit board and within said component includes at least one flange extending from said housing adjacent said first end arranged for abutting engagement with a surface of said component when said connector is urged away from said component.

11. The connector according to claim 10 wherein said component includes a panel having an opening therethrough, said first end of said housing arranged to extend into said panel opening and said flange arranged for abutting engagement with a surface of said panel.

12. An electrical connector in combination with an electrical unit having an outer case and a circuit board within said case, said case including an outer panel having an opening therethrough, said connector comprising:

an insulating housing having a first end extending into said panel opening of said panel, a pair of cavities formed side by side in said housing with a center wall therebetween, a pair of electrical contacts, one contact being in one cavity and the other contact being in the other cavity, each contact having a tail in electrical engagement with circuitry on said circuit board, a pair of first openings side by side through said first end of said housing, each being in communication with a respective cavity, said first openings and said contacts arranged so that when a conductor is inserted into a said first opening the respective contact deflects and electrically engages said conductor, said connector including securing means for securing said housing to said circuit board, and protective means for engaging said panel adjacent said panel opening when said connector is mounted to said circuit board to prevent inadvertent movement of said first end relative to said circuit board of said housing further into or through said panel opening from one side of said panel for preventing damage to said electrical contacts.

13. The combination according to claim 12 including a second opening through said first end of said housing, said second opening intersecting both of said cavities so that when a tool is inserted thereinto, both said contacts are engaged by said tool and deflected away from their respective conductors.

14. The combination according to claim 13 wherein said housing includes a stop surface in alignment with said second opening and arranged so that when said tool is inserted into said second opening to deflect said contacts away from their respective conductors, said tool engages said stop surface thereby limiting said deflection of said contacts.

15. The combination according to claim 14 wherein said stop surface is on said center wall in alignment with said second opening.

16. The combination according to claim 12 wherein said protective means comprises at least one flange extending from said housing adjacent said first end arranged in abutting engagement with a surface of said panel.

* * * * *